US006638701B1

(12) United States Patent
Kapiamba et al.

(10) Patent No.: US 6,638,701 B1
(45) Date of Patent: Oct. 28, 2003

(54) PHOTOGRAPHIC ELEMENT CONTAINING A RED DYE-FORMING PYRAZOLOTRIAZOLE COUPLER

(75) Inventors: Mbiya Kapiamba, Macedon, NY (US); David G. Lincoln, Webster, NY (US); James L. Edwards, Rochester, NY (US); Gary M. Russo, Rochester, NY (US); Gregg P. Bryant, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/321,269

(22) Filed: Dec. 17, 2002

(51) Int. Cl.[7] ..... G03C 1/08; G03C 7/26; G03C 7/32

(52) U.S. Cl. ..... 430/558; 430/503; 430/502; 430/543

(58) Field of Search ..... 430/502, 503, 430/543, 558

(56) References Cited

U.S. PATENT DOCUMENTS

| | | | | | |
|---|---|---|---|---|---|
| 4,618,573 | A | * | 10/1986 | Okamura et al. | 430/558 |
| 4,822,730 | A | * | 4/1989 | Furutachi et al. | 430/558 |
| 5,387,500 | A | * | 2/1995 | Ling et al. | 430/558 |
| 6,159,674 | A | | 12/2000 | Edwards | |
| 6,180,328 | B1 | | 1/2001 | Edwards et al. | |
| 6,521,397 | B1 | * | 2/2003 | Kapiamba et al. | 430/558 |

* cited by examiner

*Primary Examiner*—Geraldine Letscher
(74) *Attorney, Agent, or Firm*—Arthur E. Kluegel

(57) ABSTRACT

Disclosed is a photographic element comprising a a light sensitive silver halide emulsion layer having associated therewith a pyrazolotriazole dye forming coupler having formula I

I in which is and $L_1$ is linked to the C atom;

$L_1$ is a carbon atom of the triazole ring, substituted by one or two alkyl or aryl groups;

$L_2$ is a chain of one or two carbon atoms that may be further substituted by alkyl or aryl groups;

R1 is selected from the group consisting of alkyl groups containing 1–3 carbon atoms;

R2 is selected from the group consisting of hydrogen, alkyl and aryl groups;

R3 is a substituted carbonyl, carbamoyl, sulfonyl, or sulfamoyl group; and

X is H or a coupling-off group. Such an element provides a red dye forming coupler of improved stability.

15 Claims, No Drawings

PHOTOGRAPHIC ELEMENT CONTAINING A RED DYE-FORMING PYRAZOLOTRIAZOLE COUPLER

FIELD OF THE INVENTION

This invention relates to a silver halide color photographic element containing a red dye-forming coupler wherein the coupler is a pyrazolotriazole having a certain carbonamido containing substituent that provides a red dye having improved dye light stability.

BACKGROUND OF THE INVENTION

In conventional silver halide color imaging, the film employed contains three color records. A yellow dye-forming blue record, a magenta dye forming green record, and a cyan dye forming red record provide the desired color information. The problem with the conventional films is that the gamut of colors that can be formed is not as broad as would be desired and is limited by the combinations that can be made with the combination of the three dyes available.

In U.S. Pat. Nos. 6,159,674 and 6,180,328, Edwards described an improved photographic element for color imaging in which four or five separately sensitized light-sensitive silver halide emulsions are used. In addition to the three conventional cyan, magenta and yellow dye forming layers, he proposed an additional dye-forming layer comprising a coupler capable of generating a "red" dye that has a hue angle in the range of 355° and 75° and/or an additional dye-forming layer comprising a coupler capable of generating a "blue" dye that has a hue angle in the range of 225 and 310°, which resulted in an increased gamut of colors possible.

Color gamut is an important feature of color printing and imaging systems. It is a measure of the range of colors that can be produced using a given combination of colorants. It is desirable for the color gamut to be as large as possible. The color gamut of the imaging system is controlled primarily by the absorption characteristics of the set of colorants used to produce the image. Silver halide imaging systems typically employ three colorants, including cyan, magenta, and yellow dyes in the conventional subtractive imaging system.

The ability to produce an image containing any particular color is limited by the color gamut of the system and materials used to produce the image. Thus, the range of colors available for image reproduction is limited by the color gamut that the system and materials can produce.

Color gamut is often thought to be maximized by the use of so-called "block dyes". In *The Reproduction of Colour* 4th ed., R. W. G. Hunt, pp 135–144, it has been suggested that the optimum gamut could be obtained with a subtractive three-color system using three theoretical block dyes where the blocks are separated at approximately 490 nm and 580 nm. This proposal is interesting but cannot be implemented for various reasons. In particular, there are no real organic based couplers that produce dyes corresponding to the proposed block dyes.

Variations in the block dye concept are advanced by Clarkson, M., E., and Vickerstaff, T., in "Brightness and Hue of Present-Day Dyes in Relation to Colour Photography," Photo. J. 88b, 26 (1948). Three example spectral shapes are given by Clarkson and Vickerstaff: Block, Trapezoidal, and Triangular. The authors conclude, contrary to the teachings of Hunt, that trapezoidal absorption spectra may be preferred to a vertical sided block dye. Again, dyes having these trapezoidal spectra shapes are theoretical and are not available in practice.

Both commercially available dyes and theoretical dyes were investigated in "The Color Gamut Obtainable by the Combination of Subtractive Color Dyes. Optimum Absorption Bands as Defined by Nonlinear Optimization Technique," J. Imaging Science, 30, 9–12. The author, N. Ohta, deals with the subject of real colorants and notes that the existing curve for a typical cyan dye, as shown in the publication, is the optimum absorption curve for cyan dyes from a gamut standpoint.

McInerney, et al, in U.S. Pat. Nos. 5,679,139; 5,679,140; 5,679,141; and 5,679,142 teach the shape of preferred subtractive dye absorption shapes for use in four color, C,M,Y,K based ink-jet prints. McInerney, et al, in EP 0825, 488 teaches the shape of preferred subtractive cyan dye absorption shape for use in silver halide based color prints. Kitchin, et al, in U.S. Pat. No. 4,705,745, teach the preparation of a photographic element for preparing half-tone color proofs comprising four separate imaging layers capable of producing cyan, magenta, yellow and black images.

Powers, et al, in U.S. Pat. No. 4,816,378, teach an imaging process for the preparation of color half-tone images that contain cyan, magenta, yellow and, black images. The use of the black dye does little to improve the gamut of color reproduction. Haraga, et al, in EP 0915374A1, teach a method for improving image clarity by mixing 'invisible' information in the original scene with a color print and reproducing it as an infrared dye, magenta dye or as a mixture of cyan magenta and yellow dyes to achieve improved color tone and realism. The addition of the resulting infrared, magenta or black dye does little to improve the gamut.

In spite of the foregoing teachings relative to color gamut, the coupler sets which have been employed in silver halide color imaging have not provided the range of gamut desired for modern digital imaging; especially for so-called 'spot colors', Pantone® colors, or 'HiFi colors'.

In the U.S. Pat. No. 6,159,674, Jim Edwards recommends the use of cyanoacetanilides as couplers in a fourth sensitized photographic layer to produce the increase in Color Gamut. In application Ser. No. 10/122,284, filed Apr. 12, 2002, we demonstrated that 2-benzoxazoleacetonitrile-type couplers showed increased reactivity compared to the cyanoacetanilide couplers. These prior couplers are not entirely satisfactory form the standpoint of dye stability.

It remains a problem to be solved to provide a still further improved red coupler that completes a coupler set that provides an increase in color gamut to improve the accuracy of color reproduction wherein the red dye has an improved stability to light degradation.

SUMMARY OF THE INVENTION

The invention provides a photographic element comprising a light sensitive silver halide emulsion layer having associated therewith a pyrazolotriazole dye forming coupler having formula I

I

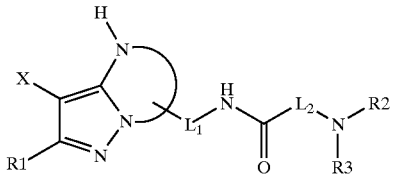

in which

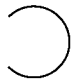

is

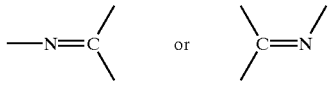

and $L_1$ is linked to the C atom;

$L_1$ is linked to the triazole ring by a carbon atom substituted by one or two alkyl or aryl groups;

$L_2$ is a chain of one or two carbon atoms that contains a sulfonyl substituent and that may be further substituted by alkyl or aryl groups;

R1 is selected from the group consisting of alkyl groups containing 1–3 carbon atoms;

R2 is selected from the group consisting of hydrogen, alkyl and aryl groups;

R3 is a substituted carbonyl, carbamoyl, sulfonyl, or sulfamoyl group; and

X is H or a coupling-off group.

DETAILED DESCRIPTION OF THE INVENTION

As summarized above, this patent application relates to the invention of 1H-Pyrazolo-1,2,4-triazoles with a particular substitution pattern that allows a hue shift such that these couplers can be used as "red" couplers in photographic applications. The couplers of this invention generate azamethine dyes that have an absorbance maximum of not more than 530 nm. These dyes are much more stable to light then the azamethine dyes generated from 2-cyanoactanilide or 2-benzoxazoleacetonitrile couplers.

As more fully described hereinafter, the couplers may be used as couplers in a fourth sensitized silver imaging layer in photographic applications. They may be prepared using a 3-substituted 4-amino-3H-1,2,4-Triazole-3-thione in which the 3 substituent is α-p-nitrophenoxyalkyl or α-acetoxyalkyl. These compounds were then converted to the corresponding 6-alkyl or 6-aryl-1H-Pyrazolo 1,2,4-triazole derivatives bearing an α-p-nitrophenoxyalkyl or α-acetoxyalkyl substituent in the 3-position. Substitution of the nitrophenoxy or acetoxy substituent by benzylamine allows the introduction of an amine functionality that can then be converted to the invention couplers by hydrogenolysis and acylation of the resulting free amine.

The photographic element of the invention comprises a light sensitive silver halide emulsion layer having associated therewith a pyrazolotriazole dye forming coupler having formula I

I

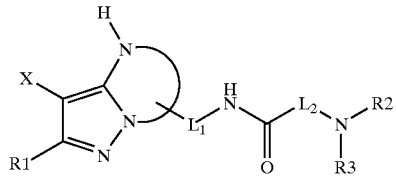

in which

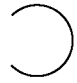

is

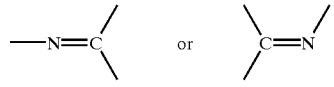

and $L_1$ is linked to the C atom;

$L_1$ is a carbon atom of the triazole ring, substituted by one or two alkyl or aryl groups;

$L_2$ is a chain of one or two carbon atoms that may be further substituted by alkyl or aryl groups;

R1 is selected from the group consisting of alkyl groups containing 1–3 carbon atoms;

R2 is selected from the group consisting of hydrogen, alkyl and aryl groups;

R3 is a substituted carbonyl, carbamoyl, sulfonyl, or sulfamoyl group; and

X is H or a coupling-off group.

R3 is desirably substituted with an alkyl or aryl group. R2 is typically H. R1 is suitably ethyl or methyl, with methyl providing the best results as far a hue. $L_1$ and $L_2$ are conveniently both methylene groups and $L_2$ usefully contains a sulfonyl substituent.

Particular examples of useful couplers are represented by formulas II and III:

II

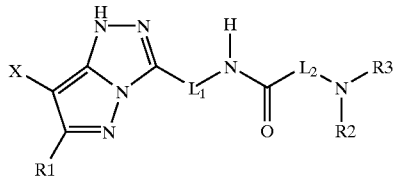

III

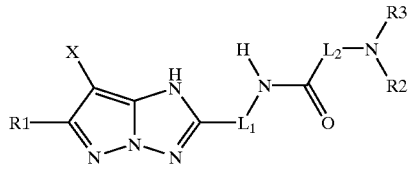

in which $L_1$ is a carbon atom of the triazole ring, substituted by one or two alkyl or aryl groups;

$L_2$ is a chain of one or two carbon atoms that may be further substituted by alkyl or aryl groups;

R1 is selected from the group consisting of alkyl groups containing 1–3 carbon atoms;

R2 is selected from the group consisting of hydrogen, alkyl and aryl groups;

R3 is a substituted carbonyl, carbamoyl, sulfonyl, or sulfamoyl group; and

X is H or a coupling-off group.

Typically, the dye forming coupler has formula IV:

IV

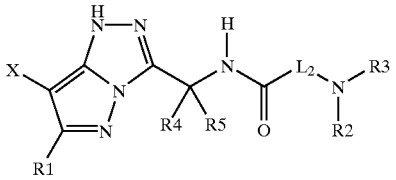

in which

R1, R2, R3, X, and $L_2$ are as described in claim 9; and

R4 and R5 are selected from the group consisting of H, alkyl and aryl, groups.

A dye forming coupler that has formula V is conveniently employed:

V

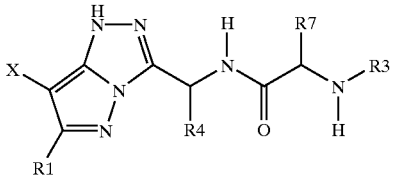

in which

R1, R3, R4, and X, are as described in claim 10; and

R7 is selected from the group consisting of hydrogen, alkyl, and aryl groups.

Desirably, $R_7$ is an alkyl group substituted by a sulfonyl group such as $—CH_2CH_2SO_2CH_3$; $R_4$ is a linear alkyl group; $R_3$ is a carbonyl or a sulfonyl group;

$R_1$ is $CH_3$, and X is hydrogen or a coupling off group such as chlorine.

Specific examples of couplers useful in the invention are:

Invention Coupler IC-1

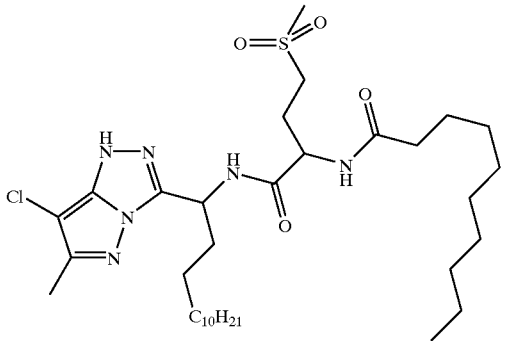

-continued

Invention Coupler IC-2

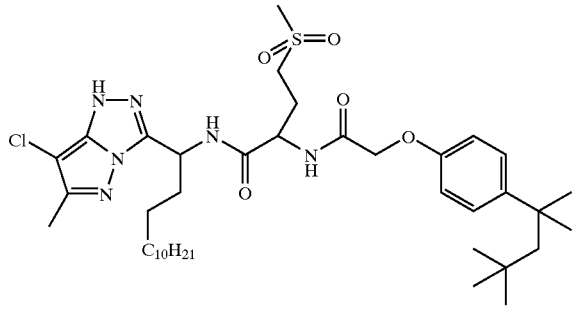

Invention Coupler IC-3

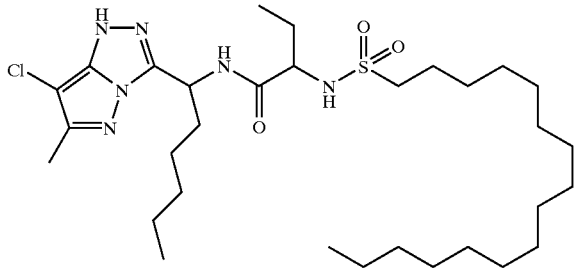

Invention Coupler IC-4

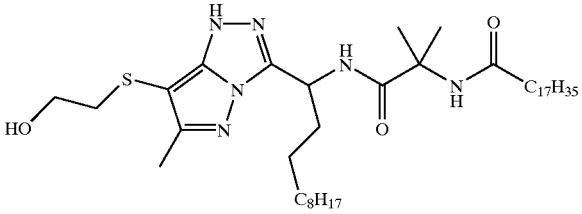

Invention Coupler IC-5

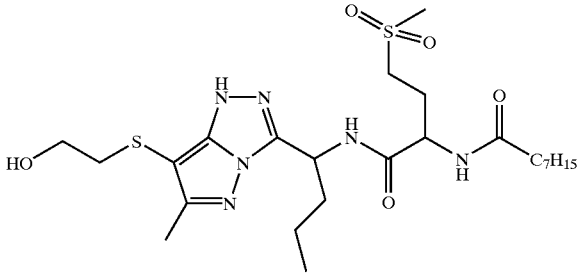

Invention Coupler IC-6

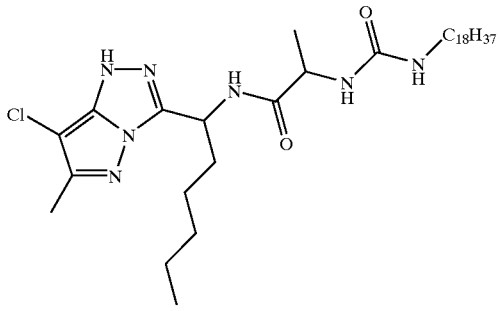

-continued
Invention Coupler IC-7
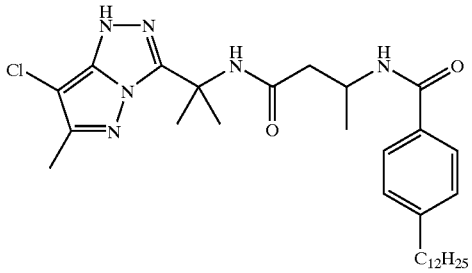
Invention Coupler IC-8
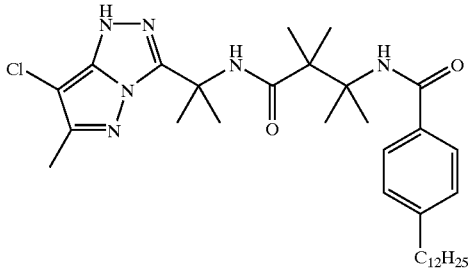
Invention Coupler IC-9
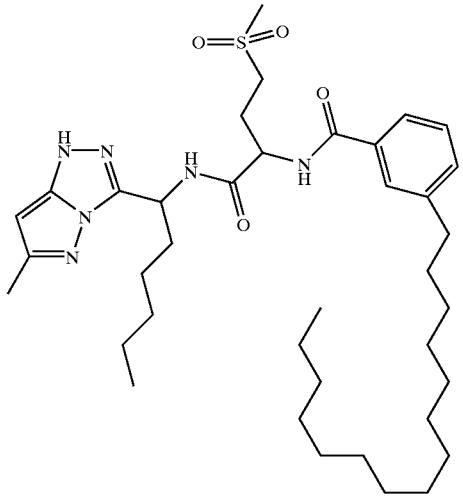
Invention Coupler IC-10
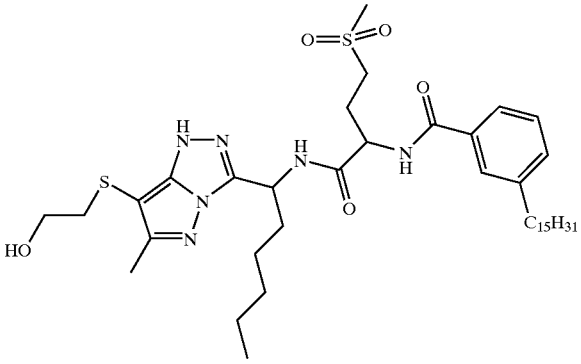
-continued
Invention Coupler IC-11
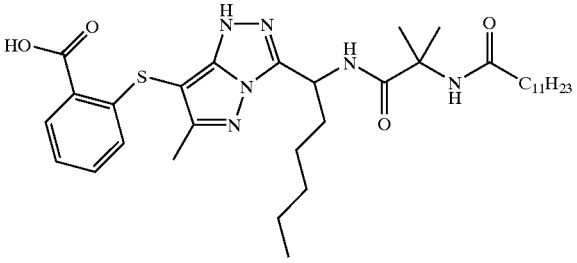
Invention Coupler IC-12
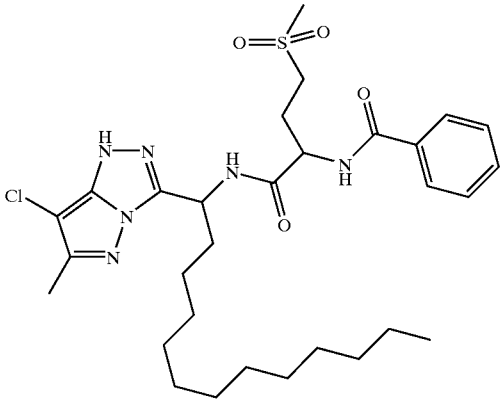
Invention Coupler IC-13
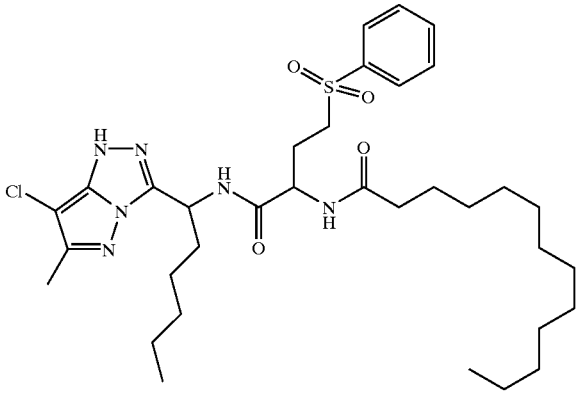
Invention Coupler IC-14
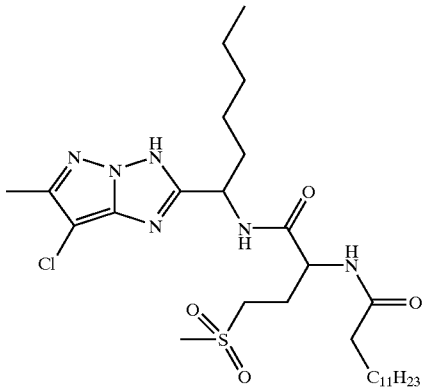

-continued

Invention Coupler IC-15

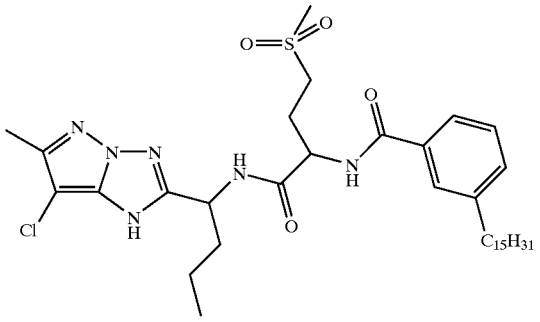

Invention Coupler IC-16

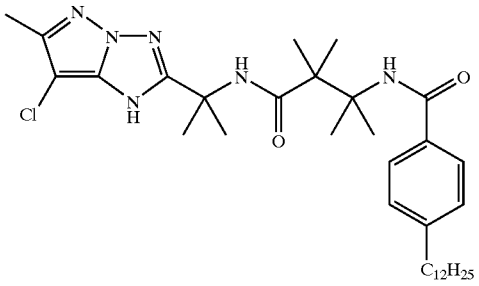

Embodiments of the invention also exhibit increased Dmax dye density, meaning that less coupler and silver is necessary to achieve a desired dye density.

The substituents to the prescribed groups may be but are not limited to an aliphatic group having preferably 1 to 32 carbon atoms which may be linear, branched or cyclic, and saturated or unsaturated, for example alkyl, aralkyl, alkenyl, alkynyl, cycloalkyl and cycloalkenyl such as methyl, ethyl, propyl, isopropyl, tert-butyl, butyl, sec-butyl, tridecyl, 2-methanesulfonylethyl, 3-(3-pentadecylphenoxy)-propyl, 3-[4-{2-[4-(4-hydroxyphenylsulfonyl)phenoxy] dodecanamide}phenyl]propyl, 2-ethoxytridecyl, trifluoromethyl, cyclopentyl, 2-(2,4-di-t-amylphenoxy) propyl and pentadecyl; aryl group, having preferably 6 to 50 atoms, for example phenyl, 4-t-butylphenyl, pentadecylphenyl, 2,4-di-t-amyl-phenyl; heterocyclic groups having preferably 1 to 50 carbon atoms, for example, 2-furyl, 2-thienyl, 2-pyridyl, 2-pyrimidinyl, 3-pyridyl, pyrazolyl, pyrrole, pyrrolidinyl, pyrazolinone.

Representative aryl groups include an aromatic nucleus such as phenyl, naphtyl or other aromatic or heteroaromatic derivatives further substituted by other groups such as linear or branched alkyls, cyclic alkyls, arylalkyls, heterarylalkyls or alkyls substituted with halogens or inert heteroatoms;

If desired, the substituents may themselves be further substituted one or more times with the described substituent groups. The particular substituents used may be selected by those skilled in the art to attain the desired photographic properties for a specific application and can include, for example, hydrophobic group, solubilizing groups, blocking groups, releasing or releasable groups, etc. Generally, the above groups or substituents thereof may include those having up to 48 carbon atoms; typically 1 to 36 carbon atoms and usually less than 24carbon atoms, but greater number are possible depending on the particular substituents selected.

Preferred couplers of this invention upon suitable coating in a silver halide photographic material provide, after conventional photographic processing, azamethine dyes with a spectral absorption peak in the region of the spectrum from 510 to 530 nm, corresponding to a CIELAB hue angle of from not less than 355° to not more than 75°.

The color photographic elements of the invention are multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one light-sensitive silver halide emulsion layer having associated therewith at least one cyan dye-forming coupler, a magenta dye image-forming unit comprising at least one light-sensitive silver halide emulsion layer having associated therewith at least one magenta dye-forming coupler, a yellow dye image-forming unit comprising at least one light-sensitive silver halide emulsion layer having associated therewith at least one yellow dye-forming coupler, and an 'blue' dye image-forming unit comprising at least one light-sensitive silver halide emulsion layer having associated therewith at least one 'blue' dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color-developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, 'blue', cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492. The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

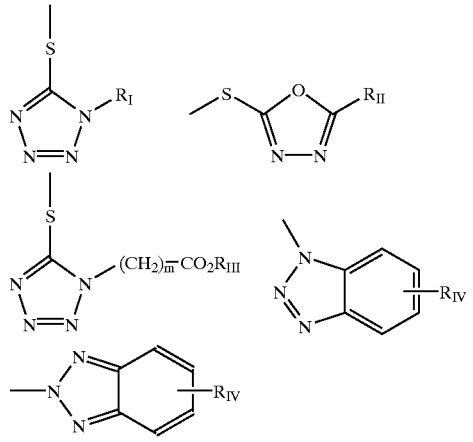

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

It is contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Ser. No. 07/978,589 filed Nov. 19, 1992, and U.S. Ser. No. 07/978,568 filed Nov. 19, 1992, both granted, in conjunction with elements of the invention.

In addition, emulsions can be sensitized with mixtures of two or more sensitizing dyes, which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response. In addition, emulsions of this invention may contain a mixture of spectral sensitizing dyes that are substantially different in their light absorptive properties. For example, Hahm, in U.S. Pat. No. 4,902,609, describes a method for broadening the effective exposure latitude of a color negative paper by adding a smaller amount of green spectral sensitizing dye to a silver halide emulsion having predominately a red spectral sensitivity. Thus when the red sensitized emulsion is exposed to green light, it has little, if any, response. However, when it is exposed to larger amounts of green light, a proportionate amount of cyan image dye will be formed in addition to the magenta image dye, causing it to appear to have additional contrast and hence a broader exposure latitude.

Waki et al. in U.S. Pat. No. 5,084,374, describes a silver halide color photographic material in which the red spectrally sensitized layer and the green spectrally sensitized layers are both sensitized to blue light. Like Hahm, the second sensitizer is added in a smaller amount to the primary sensitizer. When these imaging layers are given a large enough exposure of the blue light exposure, they produce yellow image dye to complement the primary exposure. This process of adding a second spectral sensitizing dye of different primary absorption is called false-sensitization.

Any silver halide combination can be used, such as silver chloride, silver chlorobromide, silver chlorobromoiodide, silver bromide, silver bromoiodide, or silver chloroiodide. Due to the need for rapid processing of the color paper, silver chloride emulsions are preferred. In some instances, silver chloride emulsions containing small amounts of bromide, or iodide, or bromide and iodide are preferred, generally less than 2.0 mole percent of bromide less than 1.0 mole percent of iodide. Bromide or iodide addition when forming the emulsion may come from a soluble halide source such as potassium iodide or sodium bromide or an organic bromide or iodide or an inorganic insoluble halide such as silver bromide or silver iodide.

The shape of the silver halide emulsion grain can be cubic, pseudo-cubic, octahedral, tetradecahedral or tabular. It is preferred that the 3-dimensional grains be monodisperse and that the grain size coefficient of variation of the 3-dimensional grains is less than 35% or, most preferably less than 25%. The emulsions may be precipitated in any suitable environment such as a ripening environment, or a reducing environment. Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463; Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508; Hasebe et al U.S. Pat. No. 4,820,624; Maskasky U.S. Pat. No. 5,264,337; and Brust et al EP 534,395.

The combination of similarly spectrally sensitized emulsions can be in one or more layers, but the combination of emulsions having the same spectral sensitivity should be such that the resultant D vs. log-E curve and its corresponding instantaneous contrast curve should be such that the instantaneous contrast of the combination of similarly spectrally sensitized emulsions generally increases as a function of exposure.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895, Yagi et al U.S. Pat.

No. 4,728,603, Sugimoto U.S. Pat. No. 4,755,456, Kishita et al U.S. Pat. No. 4,847,190, Joly et al U.S. Pat. No. 5,017,468, Wu U.S. Pat. No. 5,166,045, Shibayama et al EPO 0 328 042, and Kawai EPO 0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EPO 0 434 012, Inoue U.S. Pat. No. 5,185,241, Yamashita et al EPO 0 369 491, Ohashi et al EPO 0 371 338, Katsumi EPO 435 270 and 0 435 355 and Shibayama EPO 0 438 791. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et al U.S. Pat. No. 4,035,185 and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", Photographic Science and Engineering, Vol. 24, No. 6 November/December 1980, pp. 265–267 (pm, Ir, a, b and d); Hochstetter U.S. Pat. No. 1,951,933 (Cu); De Witt U.S. Pat. No. 2,628,167 (Tl, a, c); Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Tl, U, Th, Ir, Sr, Pb, b1); Habu et al U.S. Pat. No. 4,173,483 (VIII, b1); Atwell U.S. Pat. No. 4,269,927 (Cd, Pb, Cu, Zn, a2); Weyde U.S. Pat. No. 4,413,055 (Cu, Co, Ce, a2); Akimura et al U.S. Pat. No. 4,452,882 (Rh, i); Menjo et al U.S. Pat. No. 4,477,561 (pm, f); Habu et al U.S. Pat. No. 4,581,327 (Rh, cl, f); Kobuta et al U.S. Pat. No. 4,643,965 (VIII, Cd, Pb, f, c2); Yamashita et al U.S. Pat. No. 4,806,462 (pvmi, a2, g); Grzeskowiak et al U.S. Pat. No. 4,4,828,962 (Ru+Ir, b1); Janusonis U.S. Pat. No. 4,835,093 (Re, al); Leubner et al U.S. Pat. No. 4,902,611 (Ir+4); Inoue et al U.S. Pat. No. 4,981,780 (Mn, Cu, Zn, Cd, Pb, Bi, In, Tl, Zr, La, Cr, Re, VIII, c1, g, h); Kim U.S. Pat. No. 4,997,751 (Ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b); Asami U.S. Pat. Nos. 5,166,044 and 5,204,234 (Fe+Ir, a2 b, c1, c3); Wu U.S. Pat. No. 5,166,045 (Se, a2); Yoshida et al U.S. Pat. No. 5,229,263 (Ir+Fe/Re/Ru/Os, a2, b1); Marchetti et al U.S. Pat. Nos. 5,264,336 and 5,268,264 (Fe, g); Komarita et al EPO 0 244 184 (Ir, Cd, Pb, Cu, Zn, Rh, Pd, Pt, Tl, Fe, d); Miyoshi et al EPO 0 488 737 and 0 488 601 (Ir+VIII/Sc/Ti/V/Cr/Mn/Y/Zr/Nb/Mo/La/TW/Re, a2, b, g); Ihama et al EPO 0 368 304 (Pd, a2, g); Tashiro EPO 0 405 938 (Ir, a2, b); Murakami et al EPO 0 509 674 (VIII, Cr, Zn, Mo, Cd, W, Re, Au, a2, b, g) and Budz WO 93/02390 (Au, g); Ohkubo et al U.S. Pat. No. 3,672,901 (Fe, a2, o1); Yamasue et al U.S. Pat. No. 3,901,713 (Ir+Rh, f); and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, and Olm et al U.S. Ser. No. 08/091,148.

Oligomeric coordination complexes can also be employed to modify grain properties, as illustrated by Evans et al U.S. Pat. No. 5,024,931. Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Pat. No. 3,790,390 (Group VIII, a2, b1); Habu et al U.S. Pat. No. 4,147,542 (Group VIII, a2, b1); Hasebe et al EPO 0 273 430 (Ir, Rh, Pt); Ohshima et al EPO 0 312 999 (Ir, f); and Ogawa U.S. Statutory Invention Registration H760 (Ir, Au, Hg, Tl, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Ser. No. 08/091,148 are also specifically contemplated.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972; Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008, and Vandenabeele et al EPO 0 392 092.

Chemical sensitization of the materials in this invention is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or gold (aurous bis(1,4,5-trimethyl-1,2,4-triazolium-3-thiolate) tetrafluoroborate. Sulfur sensitizers may include thiosulfate, thiocyanate or N,N'-carbobothioyl-bis(N-methylglycine). The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsufinates such as tolylthiosulfinate or esters thereof are also useful.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat, No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following:

Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak RA-4 color process as described the British Journal of Photography Annual of 1988, pp 198–199. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

A direct-view photographic element is defined as one which yields a color image that is designed to be viewed directly (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by optically printing an image from a color negative onto the direct-viewing element and processing though an appropriate negative-working photographic process to give a positive color image. Color slides may be produced in a similar manner but are more typically produced by exposing the film directly in a camera and processing through a reversal color process or a direct positive process to give a positive color image. Alternative processes such as digital printing may also produce the image.

Each of these types of photographic elements has its own particular requirements for dye hue, but in general they all require cyan dyes that whose absorption bands are less deeply absorbing (that is, shifted away from the red end of the spectrum) than color negative films. This is because dyes in direct viewing elements are selected to have the best appearance when viewed by human eyes, whereas the dyes in color negative materials designed for optical printing are designed to best match the spectral sensitivities of the print materials.

Coupler Synthesis

Couplers may be synthesized as follows:

EXAMPLE 1

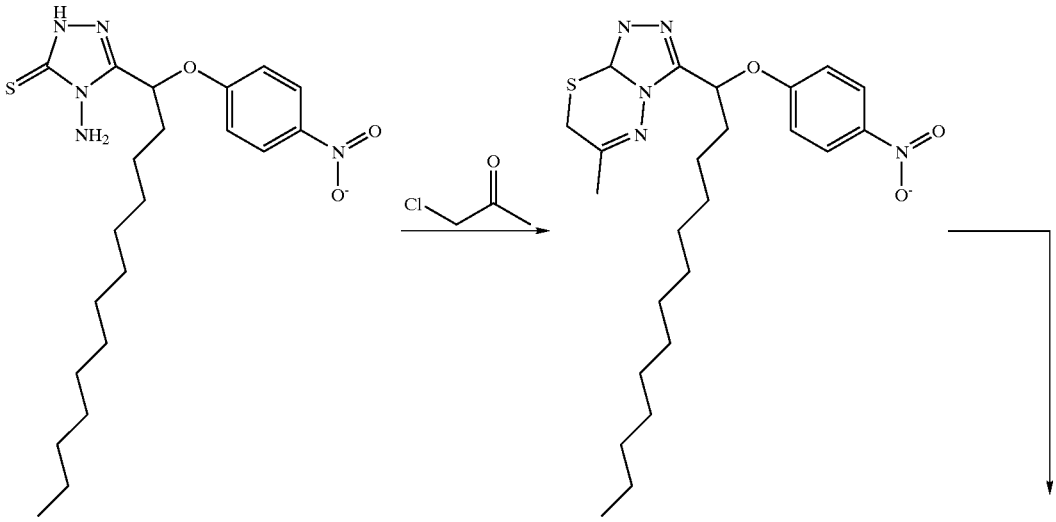

Intermediate-1 Intermediate-2

-continued

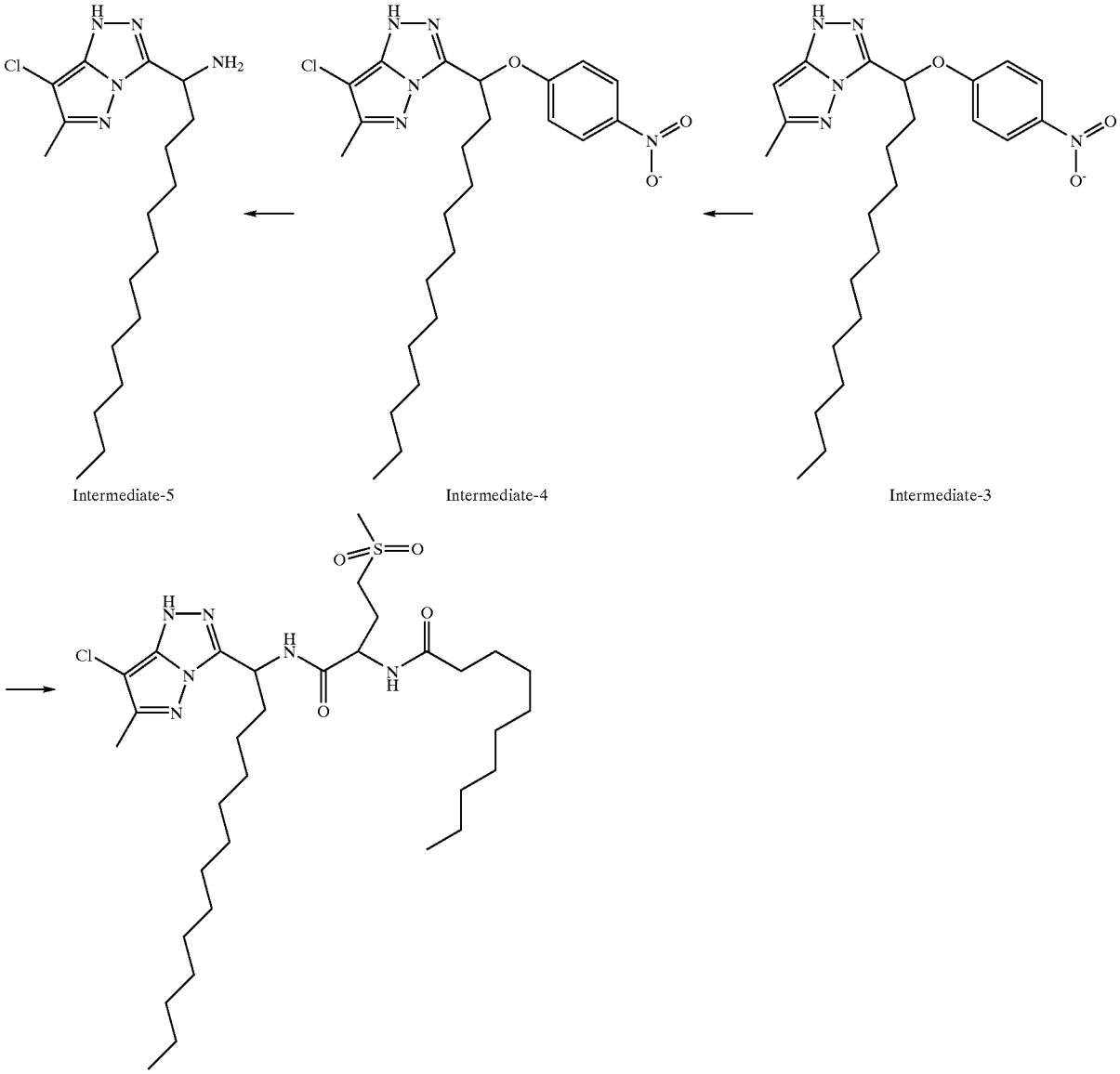

Intermediate-5 Intermediate-4 Intermediate-3

Invention coupler-1

Intermediate-1

The mixture of 2-para-nitrophenoxytetradecanoic acid and thiocarbohydrazide were heated at 145° C. for with stirring for 4 h. Heating was stopped and ethanol was added to the hot mixture. The mixture was slowly cooled to room temperature, stirred for 18 h filtered. The filtrate was evaporated and the residue was purified by flash chromatography and gave Intermediate-1 in 55% yield.

Intermediate-2

The mixture of Intermediate-1 and chloroacetone in ethanol was heated at reflux for 2 h and evaporated. The residue was dissolved in methylene chloride and washed with a half saturated sodium bicarbonate solution. The organic phase was dried over $MgSO_4$, filtered and evaporated to give Intermediate-2 in 95%).

Intermediate-3

A solution of Intermediate-2 in acetic anhydride was heated at reflux for 2.5 h. It was evaporated under reduced pressure and the residue was treated with acetic acid and hydrogen chloride. The mixture was heated at 100° C. for 1 h. After cooling to room temperature, the mixture was poured on ice-water mixture and extracted with ethyl acetate. The organic phase was dried over $MgSO_4$, filtered and evaporated. The residue was purified by flash chromatography and afforded Intermediate-3 in 41% yield.

Intermediate-4

A solution of Intermediate-3 (10 g, 22.65 mmole) and 1,3-dichloro-5,5-dimethylhydantoin (2.68 g, 13.6 mmole) in ethyl acetate (60 ml) was heated at 60° C. for 50 minutes. After cooling to about 50° C., it was treated with ascorbic acid (1.20 g, 6.79 mmole) and pyridine (1.16 g, 14.7 mmole) for 20 minutes. It was diluted with ethyl acetate (100 ml) and transferred in a separatory funnel. It was washed twice with dilute HCl (0.05M, 80 ml) and NaCl (2%, 80 ml). The organic phase was dried over $MgSO_4$, filtered and evaporated. The residue was suspended in isopropyl ether and filtered. The process was repeated three times and gave Intermediate-4 (10.46 g, 97%).

Intermediate-5

Tetrahydrofuran was placed in a Parr bottle, cooled using an ice-ethanol bath and ammonia was bubbled through the solvent for 40 minutes. Intermediate-4 was added, the Parr bottle was stoppered and the mixture was stirred at room temperature for 18 h. It was poured into cold water and extracted with ethyl acetate. The combined organic phase was dried over $MgSO_4$, filtered and evaporated. The residue was purified by flash chromatography (Ethyl acetate) and gave Intermediate-4 in 43% yield.

Invention Coupler-1

A solution of phosphorus trichloride in pyridine was slowly added to a solution of Intermediate-5 in pyridine at 0° C. The mixture was stirred at 0° C. for 20 minutes and then 1 h at room temperature. The carboxylic acid was added and the mixture was heated at 80° C. for 3 h, and then left at room temperature for 17 h. It was evaporated and the residue was dissolved in ethyl acetate and successively washed with water and dilute $NaHCO_3$. The organic phase was dried over $MgSO_4$, filtered and evaporated. The residue was purified by flash chromatography and gave Invention coupler-1 in 72% yield.

EXAMPLE 2

Intermediate-6

The mixture of 4-amino-5-[1-(4-nitrobenzyl)hexyl]-2,4-dihydro-3H-1,2,4-triazole-3-thione (7 g), α-bromopinacolone (3.71 g) in ethanol (80 ml) was heated at reflux for 4 h. It was evaporated under reduced pressure. The residue was dissolved on ethyl acetate (200 ml); water (100 ml) and saturated $NaHCO_3$ (50 ml) were added. The two phases were separated and the organic phase was dried over $MgSO_4$, filtered and evaporated. The residue was purified by flash chromatography (Ethyl acetate/P950 ligroin: 1/1) and afforded 5 g of the Intermediate-6.

Intermediate-7

A solution of Intermediate-6 (5 g, 12 mmole) in acetic an hydride (30 ml) was heated at reflux for 3 h. It was evaporated under reduced pressure and the residue was treated with acetic acid (25 ml) and hydrogen chloride (5 ml). The mixture was heated at 100° C. for 1 h. After cooling to room temperature, the mixture was poured on 100 g of ice-water mixture. After warming to room temperature, the solid that formed was filtered and gave Intermediate-7 (4.06 g, 88%).

Intermediate-8

THF (80 ml) was placed in a Parr bottle and cooled using an ice-ethanol mixture. Ammonia was bubbled through the solvent for 30 minutes. Intermediate-7 (2 g, 5.2 mmole) was

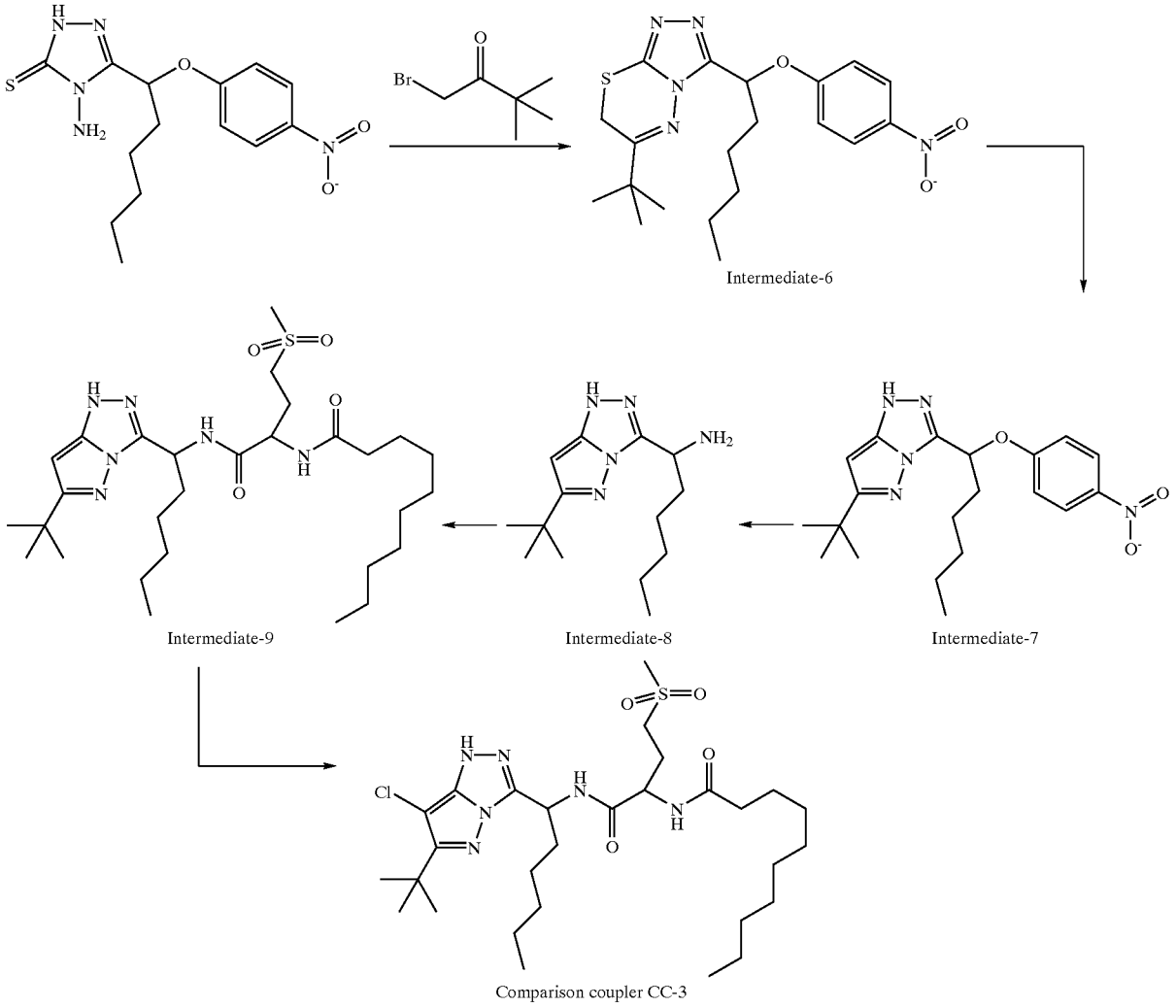

then added and the Parr bottle was stoppered. The mixture was then stirred at room temperature for 18 h. It was poured into cold water (80 ml) and extracted with ethyl acetate (2×100 ml). The organic phase was dried over $MgSO_4$, filtered and evaporated. The residue was purified by flash chromatography (Ethyl acetate/P950 ligroin: 1/1) and gave Intermediate-8 (0.66 g, 48%).

Intermediate-9

A solution of phosphorus trichloride (0.17 g, 1.28 mmole) in pyridine (2 ml) was slowly added to a solution of Intermediate-8 (0.66 g, 2.5 mmole) in pyridine (9 ml). The mixture was stirred at 0° C. for 20 minutes and then 1 h at room temperature. The acid (0.91 g, 2.5 mmole) was added and the mixture was heated at 80° C. for 3 h, and then left at room temperature for 17 h. It was evaporated and the residue was dissolved in ethyl acetate (120 ml) and successively washed with water (60 ml) and dilute $NaHCO_3$ (60 ml). The organic phase was dried over $MgSO_4$, filtered and evaporated. The residue was purified by flash chromatography (EtOAc/P950 ligroin: 7/3) and gave Intermediate-9 (0.48 g, 31%).

Comparison Coupler CC-3

1,3-dichloro-5,5-dimethylhydantoin (0.09 g, 0.44 mmole) was added to a solution of KAN 055459-3 (0.45 g, 0.74 mmole) in ethyl acetate (10 ml). The mixture was heated at 60° C. for 2 h. Ascorbic acid (0.10 g, 0.6 mmole) and methanol (5 ml) were added and the mixture was stirred at 70° C. for 3 h. It was then diluted with ethyl acetate (100 ml), washed with dilute HCl (0.2 M, 2×50 ml) followed by dilute NaCl solution. The organic phase was dried over $MgSO_4$, filtered and evaporated. The residue was purified by flash chromatography (Ethyl acetate) and gave Comparison Coupler CC-3 (0.22 g, 47%).

EXAMPLE 3

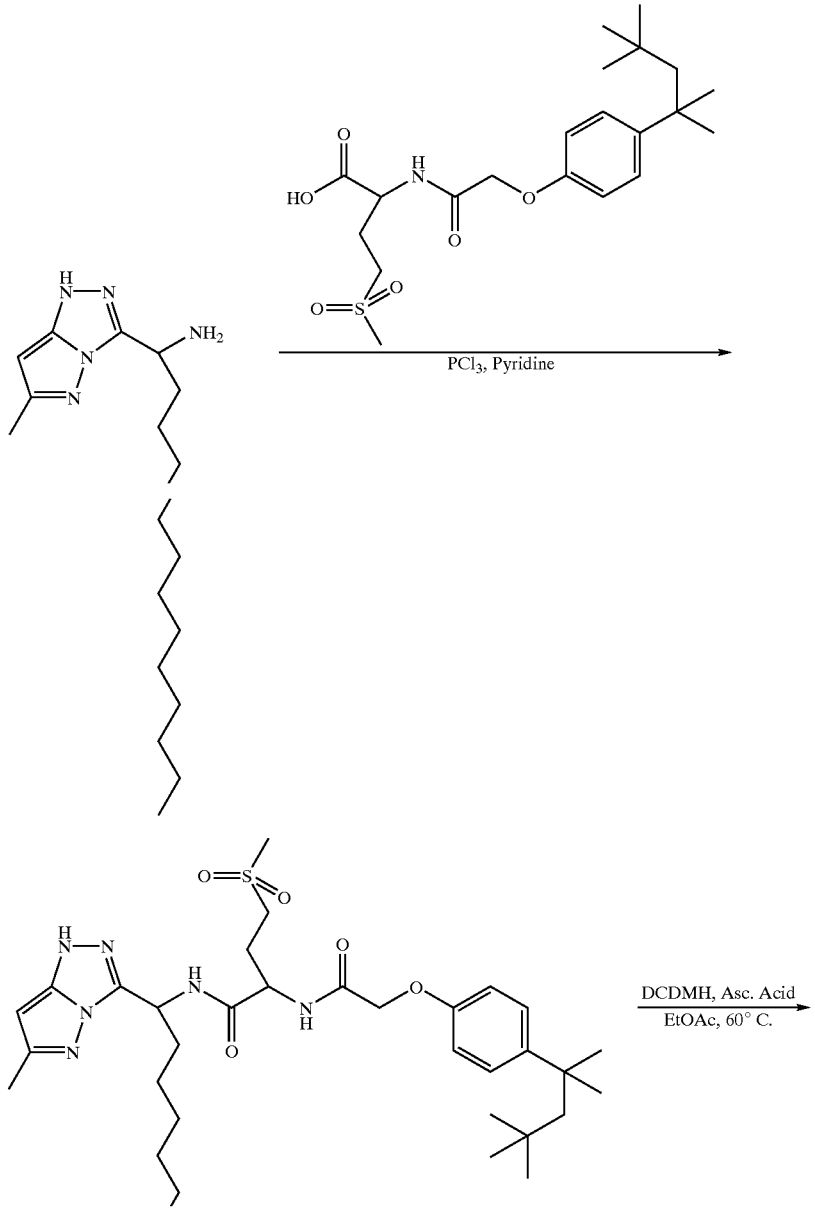

-continued

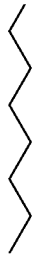

Intermediate I-10

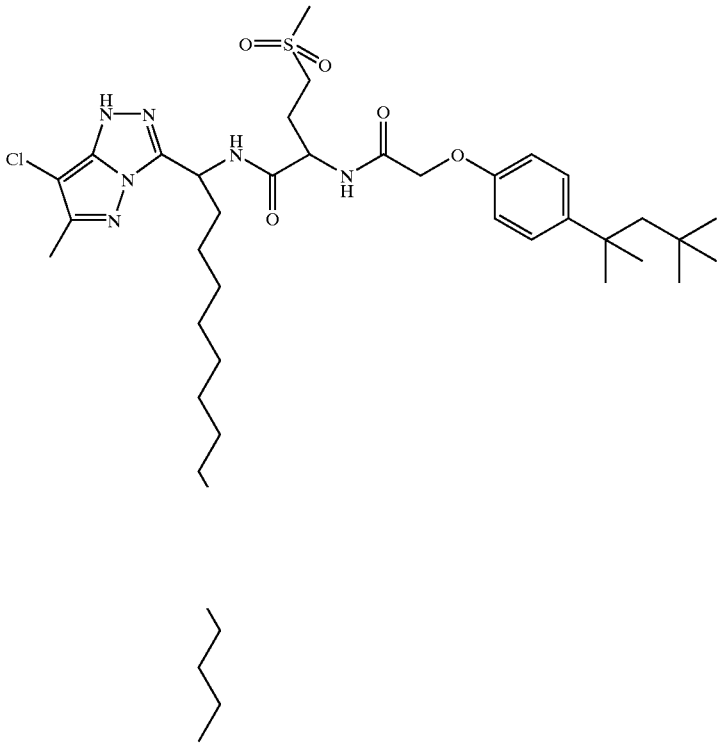

Invention coupler IC-2

Intermediate I-10

A solution of phosphorus trichloride (0.25 g, 1.85 mmole) in pyridine (3 ml) was slowly added to a solution of 1-(6-methyl-1H-pyrazolo[5,1-c][1,2,4]triazol-3-yl)tridecan-1-amine (1.16 g, 3.6 mmole) in pyridine (10 ml). The mixture was stirred at 0° C. for 20 minutes and then 1 h at room temperature. The 4-(methylsulfonyl)-2-[(4-(1,1,3,3-tetramethylbutyl)phenoxyacetyl)amino]-butanoic acid (1.55 g, 3.6 mmole) was added and the mixture was heated at 80° C. or 3 h, and then left at room temperature for 17 h. It was evaporated and the residue was dissolved in ethyl acetate (100 ml) and successively washed with water (100 ml) and dilute $NaHCO_3$ (60 ml). The organic phase was dried over $MgSO_4$, filtered and evaporated. The residue was purified by flash chromatography (EtOAc) and gave the Intermediate 1–10 (1.09 g, 41%).

Invention Coupler IC-2

1,3-dichloro-5,5-dimethylhydantoin (0.32 g, 1.6 mmole) was added to a solution of Intermediate 1–9 (1.09 g, 1.5 mmole) in ethyl acetate (15 ml). The mixture was heated at 60° C. for 2 h. Ascorbic acid (0.32 g, 1.8 mmole), pyridine (0.29 g, 3.73 mmole) and methanol (15 ml) were added and the mixture was stirred at reflux for 16 h. It was then diluted with ethyl acetate (100 ml), washed with dilute HCl (0.2 M, 2×50 ml) followed by dilute NaCl solution (50 ml). The organic phase was dried over $MgSO_4$, filtered and evaporated. The residue was purified by flash chromatography (Ethyl acetate/P950 ligroin: 3/7) and gave Invention Coupler IC-2 (0.6 g, 53%).

EXAMPLE 4

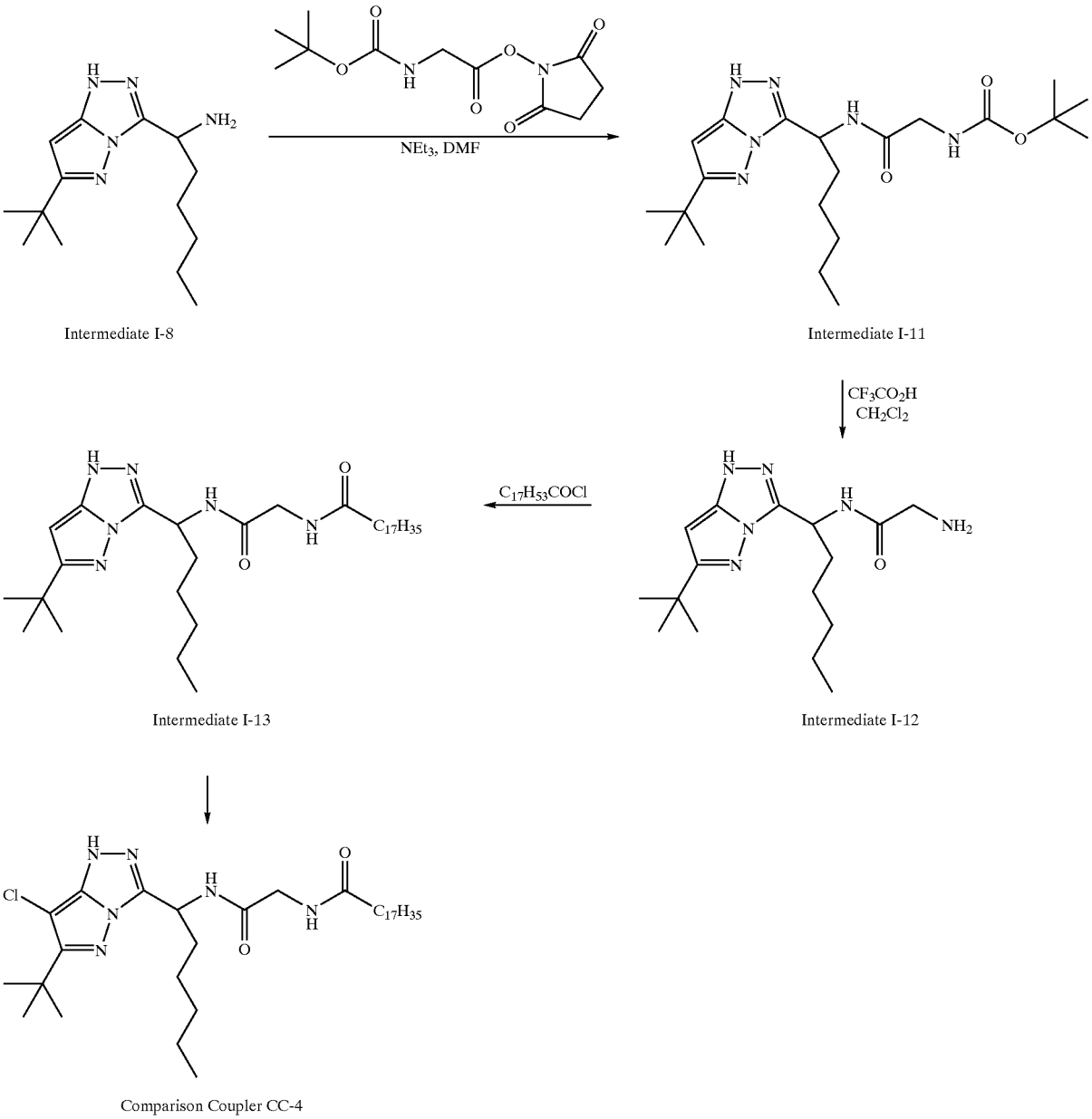

Intermediate I-11

A solution of 1-(6-methyl-1H-pyrazolo[5,1-c][1,2,4] triazol-3-yl)hexan-1-amine (1.74 g, 6.6 mmole) in DMF (20 ml) was treated with N-BOC-glycine-N-hydroxysuccinimide ester (1.65 g, 7.27 mmole) and triethylamine (1.67 g, 16.5 mmole). The mixture was stirred at room temperature for 3 h. It was poured into cold water (100 ml) and extracted with ether (3×100 ml). The combined organic phase was dried over $MgSO_4$, filtered and evaporated. The residue was purified by flash chromatography (EtOAc/P950 ligroin: 7/3) and afforded 1.85 g (66%) of Intermediate I-11.

Intermediate I-12

A solution of of Intermediate I-11 (1.25 g, 2.97 mmole) in methylene chloride (10 ml) was treated with trifluoroacetic acid (5 ml). The mixture was stirred at room temperature for 1 h and evaporated. Ethyl acetate (100 ml) was added to the residue and the solution was washed with $NaHCO_{3sat}$ (100 ml). The two phases were separated and the aqueous phase was extracted with ethyl acetate (2×50 ml). The combined organic phase was dried over $MgSO_4$, filtered and evaporated to give of Intermediate I-12 (0.77 g, 81%).

Intermediate I-13

The mixture of of Intermediate I-12 (0.77 g, 2.4 mmole) and stearoyl chloride (0.95 g, 3.12 mmole) in toluene (15 ml) was heated at reflux for 18 h. Methanol (15 ml) and potassium hydroxide (0.22 g, 3.84 mmole) were added and the mixture was stirred at room temperature for 40 minutes. It was then transferred in a separatory funnel and diluted with 100 ml of ethyl acetate. The solution was washed with HCl 0.5N (80 ml) and the aqueous phase was extracted with ethyl acetate (100 ml). The organic phase was dried over $MgSO_4$, filtered and evaporated. The residue was purified by flash chromatography (Ethyl acetate) and gave of Intermediate I-13 (0.87 g, 62%).

Comparison Coupler CC-4

A solution of Intermediate 1–13 (0.87 g, 1.48 mmole) and N-chlorosuccinimide (0.24 g, 1.78 mmole) in ethyl acetate (10 ml) was heated at reflux for 3 h. To the mixture was then added methanol (10 ml) and ascorbic acid (0.5 g, 2.8 mmole). The mixture was heated at reflux for 1 h, diluted with ethyl acetate (120 ml) and washed with HCl 0.5N (2×80 ml) and $NaCl_{sat}$ (100 ml). The organic phase was dried over $MgSO_4$, filtered and evaporated. The residue was crystallized from a mixture of ethyl acetate and P950 ligroin (6/4) and gave Invention Coupler CC-4 (0.67 g, 73%).

EXAMPLE 5

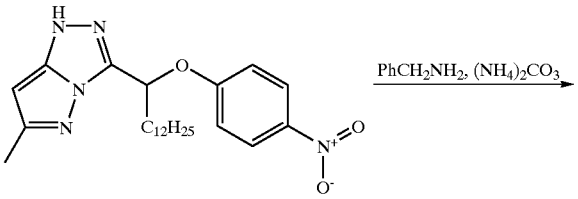

Intermediate I-3

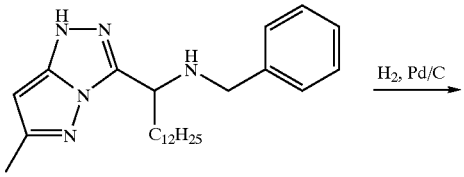

Intermediate I-20

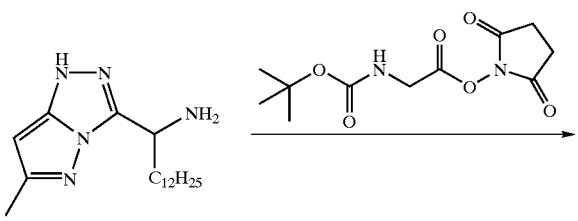

Intermediate I-21

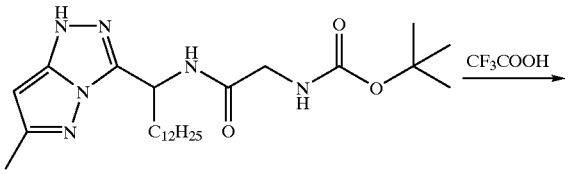

Intermediate I-22

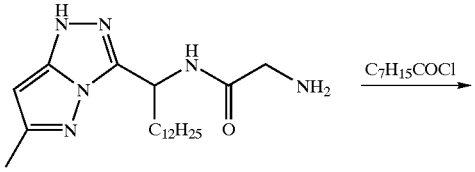

Intermediate I-23

-continued

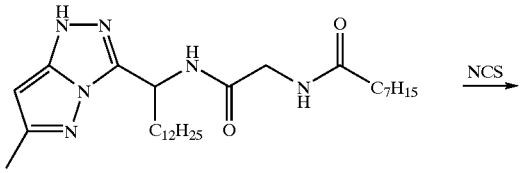

Intermediate I-24

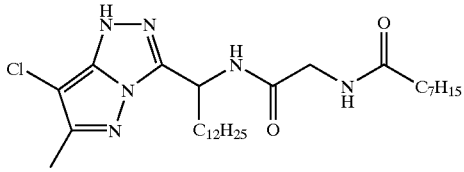

Comparison Coupler CC-5

Intermediate I-20

A solution of Intermediate I-3 (25 g, 56.6 mmole) in 2-propanol (200 ml) was treated with benzylamine (7.89 g, 73.6 mmole) and ammonium carbonate (10.88 g, 0.11 mole). The mixture was heated at reflux for 4 h. It was diluted with 400 ml of ethyl acetate and washed with saturated $Na_2CO_3$ (2×200 ml). The two phases were separated and the organic phase was dried over $MgSO_4$, filtered and evaporated. The residue was suspended in KOH 1N (250 ml), stirred for 30 minutes and filtered. The solid was isolated by filtration and air dried to give Intermediate I-20 (23 g, 99%).

Intermediate I-21

A solution of Intermediate I-20 (15 g, 36.6 mmole) in methanol (150 ml) and acetic acid (25 ml) was treated with Palladium on carbon (2 g) and hydrogenated under 50 psi for 5 h. The mixture was filtered over a patch of celite (2 cm) covered with Norit activated carbon and washed with methanol. The filtrate was evaporated and the residue was triturated with ethyl acetate and ether and filtered to give Intermediate I-21 (7.63 g, 65%).

Intermediate I-22

The mixture of Intermediate I-21 (2.5 g, 7.82 mmole), N-Boc glycine-N-hydroxysuccinimide ester (2.34 g, 8.61 mmole) and triethylamine (1.98 g, 19.6 mmole) in DMF (25 ml) was stirred at room temperature for 2 h. It was diluted with ether (150 ml) and water (80 ml). The two phases were separated and the aqueous phase was extracted with ether (2×80 ml). It was dried over $MgSO_4$, filtered and evaporated. The residue was triturated with ethyl acetate and ether and filtered to give Intermediate I-22 (1.34 g). The filtrate was evaporated and the residue purified by flash chromatography to provide more product (0.26 g) for a total yield of 1.6 g (43%).

Intermediate I-23

A suspension of Intermediate I-22 (1.5 g, 3.15 mmole) in methylene chloride (10 ml) was treated with trifluoroacetic acid (3 ml). The mixture was stirred at room temperature for 2 h. It was evaporated and the residue was partitioned between ethyl acetate (100 ml) and saturated $NaHCO_3$ (80 ml). The two phases were separated and the aqueous phase was extracted with ethyl acetate (2×80 ml). The organic phase was dried over $MgSO_4$, filtered and evaporated. The residue was triturated with propyl acetate and ether and filtered to give Intermediate I-23 (1.06 g, 90%).

Intermediate I-24

The mixture of Intermediate I-23 (1.06 g, 2.81 mmole) and octanoyl chloride (1.05 g, 6.47 mmole) in toluene (15 ml) was heated at reflux 20 h. After cooling to room temperature, the mixture was treated with methanol (16 ml) and potassium hydroxide (0.32 g, 5.63 mmole) and stirred at room temperature for 1 h. The mixture was transferred in a separatory funnel, diluted with ethyl acetate (100 ml) and washed with HCl 0.5N (80 ml). The two phases were separated and the aqueous phase was further extracted with ethyl acetate (80 ml). The organic phase was dried over $MgSO_4$, filtered and evaporated. The residue was triturated with ethyl acetate and ether and the solid was filtered to give 0.49 g of Intermediate I-24. The filtrate was evaporated and the residue was purified by flash chromatography (ethyl acetate) and gave 0.19 g of Intermediate I-24 for a total yield of 0.62 g (44%).

Comparison Coupler CC-5

The mixture of Intermediate I-24 (0.53 g, 1.05 mmole) and N-chlorosuccinimide (0.17 g, 1.26 mmole) in ethyl acetate (15 ml) was heated at reflux for 4 h. It was treated with methanol (10 ml) and ascorbic acid (0.3 g). The resulting mixture was heated at reflux for 1 h, diluted with ethyl acetate (80 ml) and washed with dilute HCl (2×80 ml) and dilute NaCl (80 ml). The organic phase was dried over $MgSO_4$, filtered and evaporated. The residue was purified by flash chromatography (Ethyl acetate) and gave Comparison coupler CC-5 (0.4 g, 70%).

PHOTOGRAPHIC EXAMPLES

The following examples illustrate the practice of the present invention in a silver halide photographic element and the advantage in maximum dye density generated ($D_{max}$) and speed of the resultant "Red" image dyes resulting in the elements of the invention compared with the comparison elements using comparison couplers shown below. (Table I).

Comparison Coupler CC-1

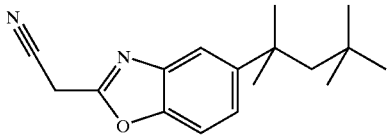

Comparison Coupler CC-2

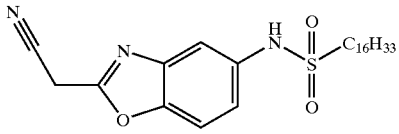

Comparison Coupler CC-3

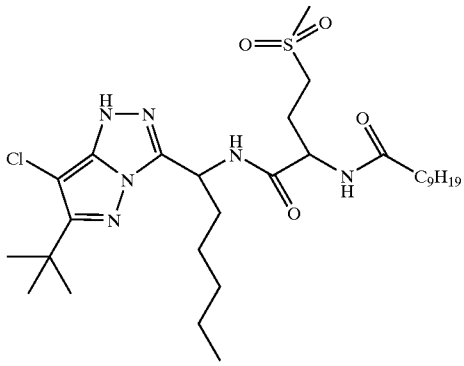

-continued

Comparison Coupler CC-4

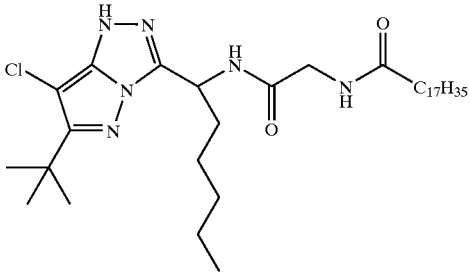

Comparison Coupler CC-5

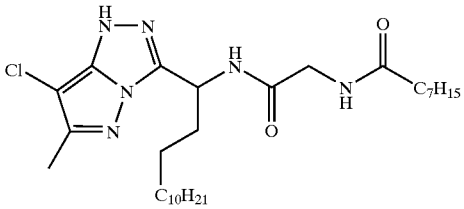

The comparison couplers CC-1 and CC-2 represent the class of benzoxazole couplers described in the previous patent application described in the background of the invention. These couplers generated azamethine dyes with a good hue but showed very poor light stability. The comparison couplers CC-3 and CC-4 represent pyrazolotriazole couplers in which the amino acid side chain feature employed in the present invention is missing and establish the specific influence of this substitution pattern on the desired properties of a "Red" coupler.

Single Layer Coating Containing a Red Sensitized Emulsion

A silver chloride emulsion was chemically and spectrally sensitized as is described below.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 $\mu$m in edge length. In addition, ruthenium hexacyanide dopant (at 16.5 mg/Ag-M) and $K_2IrCl_5$ (5-methylthiazole) dopant (at 0.99 mg/Ag-M) were added during the precipitation process. This emulsion was optimally sensitized by the addition of a colloidal suspension of aurous sulfide (60 mg/Ag-M) followed by a heat ramp to 65° C. for 45 minutes, and further additions of 1-(3-acetamidophenyl)-5-mercaptotetrazole (295 mg/Ag-M), iridium dopant, $K_2IrCl_6$ (149 $\mu$g/Ag-M), potassium bromide, (0.5 Ag-M %), and red sensitizing dye RSD-1 (7.1 mg/Ag-M).

RSD-1

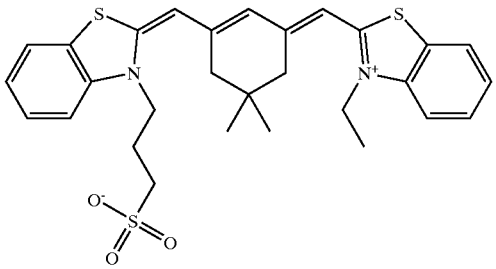

Dispersions of example couplers, were emulsified by methods well known to the art, and were coated on the face side of a doubly extruded polyethylene coated color paper support using conventional coating techniques. The gelatin layers were hardened with bis(vinylsulfonyl methyl) ether at 2.4% of the total gelatin. The emulsion described above was evaluated in a single emulsion layer-coating format using conventional coating preparation methods and techniques. This coating format is described below in detail:

TABLE 1

Single Layer Coating Format

| Layer | Coating Material | Coverage mg/M$^2$ |
|---|---|---|
| Overcoat | Gelatin | 1064. |
| | Gel hardener | 105. |
| Imaging | Emulsion Red EM-1 | Varies between 75.3 and 322.8 |
| | Couplers as indicated | Varies between 237 to 323 |
| | Gelatin | 1658. |
| Adhesion sub-layer | Gelatin | 3192. |
| Polyethylene coated paper support | | |

Once the coated paper samples described above had been prepared, they were given a preliminary evaluation as follows:

The respective paper samples were exposed in a Kodak Model 1B sensitometer with a color temperature of 3000° K. and filtered with a Kodak Wratten™ 2C plus a Kodak Wratten™ 29 filter and a Hoya HA-50. Exposure time was adjusted to 0.1 seconds. The exposures were performed by contacting the paper samples with a neutral density step exposure tablet having an exposure range of 0 to 3 log-E.

The paper samples described above as coating examples 1 to 17 were processed in the Kodak Ektacolor RA-4 Color Development™ process. The color developer and bleach-fix formulations are described below in Tables 2 and 3. The chemical development process cycle is described in Table 4.

TABLE 2

Kodak Ektacolor ™ RA-4 Color Developer

| Chemical | Grams/Liter |
|---|---|
| Triethanol amine | 12.41 |
| Phorwite REU ™ | 2.30 |
| Lithium polystyrene sulfonate (30%) | 0.30 |
| N,N-diethylhydroxylamine (85%) | 5.40 |
| Lithium sulfate | 2.70 |

TABLE 2-continued

Kodak Ektacolor ™ RA-4 Color Developer

| Chemical | Grams/Liter |
|---|---|
| Kodak color developer CD-3 | 5.00 |
| DEQUEST 2010 ™ (1-Hydroxyethyl-1,1-diphosphonic acid (60%) | 1.16 |
| Potassium carbonate | 21.16 |
| Potassium bicarbonate | 2.79 |
| Potassium chloride | 1.60 |
| Potassium bromide | 0.007 |
| Water | to make 1 liter |

pH @ 26.7° C. is 10.04 +/− 0.05

TABLE 3

Kodak Ektacolor ™ RA-4 Bleach-Fix

| Chemical | Grams/Liter |
|---|---|
| Ammonium thiosulfate (56.5%) | 127.40 |
| Sodium metabisulfite | 10.00 |
| Glacial acetic acid | 10.20 |
| Ammonium ferric EDTA (44%) | 110.40 |
| Water | to make 1 liter |

pH @ 26.7° C. is 5.5 +/− 0.10

TABLE 4

Kodak Ektacolor ™ RA-4 Color Paper Process

| Process Step | Time (seconds) |
|---|---|
| Color Development | 45 |
| Bleach-fix | 45 |
| Wash | 90 |
| Dry | |

Processing the exposed paper samples is performed with the developer and bleach-fix temperatures adjusted to 35° C. Washing is performed with tap water at 32.2° C.

To facilitate comparisons, the characteristic vector, also determined from principle component analysis was determined using standard characterization methods since the absorption characteristics of a given colorant will vary to some extent with a change in colorant amount. This is due to factors such as measurement flare, colorant-colorant interaction, colorant-support interactions, colorant concentration effects and the presence of color impurities in the media. However, by using characteristic vector analysis, one can determine a characteristic absorption curve that is representative of the absorption characteristics of the colorant over the complete wavelength and density ranges of interest. This technique is described by J. L. Simonds in the Journal of the Optical Society of America, 53(8), 968–974, 1963.

The spectral absorption curve of each dye was measured using a MacBeth Model 2145 Reflection Spectrophotometer having a Xenon pulsed source and a 10 nm nominal aperture. Reflection measurements were made over the wavelength range of 380–750 nanometers using a measurement geometry of 45/0, and the characteristic vector (transmission density -vs.- wavelength) for each coupler specimen was calculated. The color gamut's resulting from using the characteristic vectors to calculate the gamut using the methods as described in J. Photographic Science, 38, 163 (1990) were determined and the results are given in Table III. Color gamuts are obtained by the above calculation method, assuming the use of resin-coated photographic paper base material, no light scatter, a D5000 viewing illuminant, and a Dmax of 2.2. The optimal spectral regions hold true for any Dmin, any amount of flare, any Dmax and any viewing illuminant.

The λ-max (normalized to 1.0 density) of the characteristic vector of each dye, the $D_{max}$, the speed, the resulting Color Gamut and the density loss from a density value of 1.0 of the corresponding azamethine dye at 54Klux for 2 weeks is summarized in Table 5 below:

TABLE 5

| | | Results | | | | |
|---|---|---|---|---|---|---|
| Element | Coupler | $\lambda_{max}$ | $D_{max}$ | Speed | Gamut | LS* (2 wk) |
| Element-1 | CC-1 | 514 | 1.72 | 144.6 | 63,704 | −0.85 |
| Element-2 | CC-2 | 520 | 1.99 | 148.6 | 63,567 | −0.86 |
| Element-3 | CC-3 | 550.0 | 2.27 | 144.1 | 60,857 | −0.16 |
| Element-4 | CC-4 | 549.6 | 2.8 | 157 | 61,323 | −0.13 |
| Element-5 | CC-5 | 540 | 2.9 | 165.4 | 61,984 | −0.6 |
| Element-6 | IC-1 | 510 | 2.18 | 140.1 | 63,218 | −0.6 |
| Element-7 | IC-2 | 530 | 2.49 | 155.7 | 63,018 | −0.6 |

*Density Loss from 1.0

The maximum dye density values, the film speed as well as the color gamut results in Table 5 clearly show that the photographic element of the invention tested clearly produce more red dye density than the benzoxazoleacetonitrile class of couplers (Comparison couplers CC-1 and CC-2). The dyes produced by the couplers of the present invention are also more stable to light than the comparison couplers CC-1 and CC-2.

The results of the table also show that when compared to other similar triazole couplers (Comparison couplers CC-3, CC-4 and CC-5), the couplers useful in the invention are able to produce dyes with an absorbance maximum comprised between 490 nm and 530 nm, characteristic of "red" couplers rather than "magenta" couplers that have a maximum above 530 nm. The couplers of this invention also produce a photographic element with a superior gamut compared to the comparison couplers CC-3, CC-4 and CC-5.

What is claimed is:

1. A photographic element comprising a a light sensitive silver halide emulsion layer having associated therewith a pyrazolotriazole dye forming coupler having formula I

I

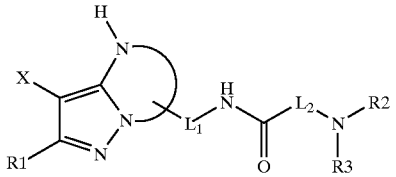

in which

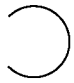

is

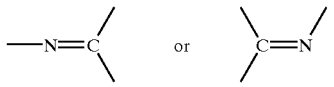

and $L_1$ is linked to the C atom;

$L_1$ is linked to the triazole ring by a carbon atom substituted by one or two alkyl or aryl groups;

$L_2$ is a chain of one or two carbon atoms that contains a sulfonyl substituent and that may be further substituted by alkyl or aryl groups;

R1 is selected from the group consisting of alkyl groups containing 1–3 carbon atoms;

R2 is selected from the group consisting of hydrogen, alkyl and aryl groups;

R3 is a substituted carbonyl, carbamoyl, sulfonyl, or sulfamoyl group; and

X is H or a coupling-off group.

2. The element of claim 1 wherein R3 is substituted with an alkyl or aryl group.

3. The element of claim 1 wherein R2 is H.

4. The element of claim 1 wherein R1 is ethyl or methyl.

5. The element of claim 1 wherein R1 is methyl.

6. The element of claim 1 wherein $L_1$ and $L_2$ are both methylene groups.

7. A photographic element of claim 1 comprising a support bearing a light sensitive silver halide emulsion layer having associated therewith a dye forming coupler having a formula II or formula III,

II

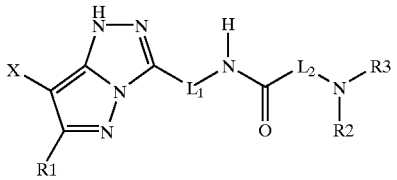

III

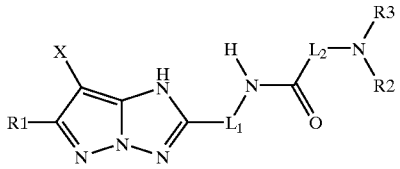

in which $L_1$ is linked to the triazole ring by a carbon atom substituted by one or two alkyl or aryl groups;

$L_2$ is a chain of one or two carbon atoms that contains a sulfonyl substituent and that may be further substituted by alkyl or aryl groups;

R1 is selected from the group consisting of alkyl groups containing 1–3 carbon atoms;

R2 is selected from the group consisting of hydrogen, alkyl and aryl groups;

R3 is a substituted carbonyl, carbamoyl, sulfonyl, or sulfamoyl group; and

X is H or a coupling-off group.

8. The photographic element of claim 7 wherein the dye-forming coupler has formula II.

9. The photographic element of claim 8 wherein the dye forming coupler has formula IV:

IV

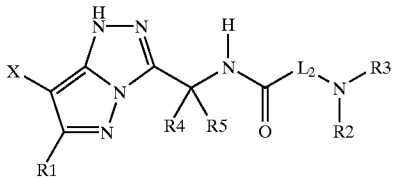

in which

R1, R2, R3, X, and $L_2$ are as described in claim 8; and

R4 and R5 are selected from the group consisting of H, alkyl and aryl, groups.

10. The photographic element of claim 9 wherein the dye forming coupler has formula V:

V

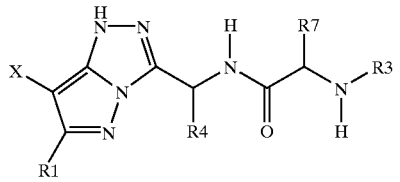

in which

R1, R3, R4, and X, are as described in claim 9; and

R7 is selected from the group consisting of hydrogen, alkyl, and aryl groups.

11. The photographic element of claim 10 wherein R7 is an alkyl group substituted by a sulfonyl group.

12. The photographic element of claim 10 wherein:

$R_4$ is a linear alkyl group;

$R_3$ is a carbonyl or a sulfonyl group; and

X is hydrogen or a coupling off group.

13. The photographic element of claim 8 wherein $R_1$ is $CH_3$.

14. The photographic element of claim 8 wherein $R_7$ is —$CH_2CH_2SO_2CH_3$.

15. The photographic element of claim 8 wherein X is chlorine.

* * * * *